US006082588A

United States Patent [19]

Markey et al.

[11] Patent Number: 6,082,588

[45] Date of Patent: Jul. 4, 2000

[54] DUAL COMPARTMENT PACKAGE AND PUMPS

[75] Inventors: Kevin Joseph Markey; Mark Douglas Gerhart, both of Westminster; Gregory Alan Lathrop, Manchester, all of Md.

[73] Assignee: Lever Brothers Company, division of Conopco, Inc., New York, N.Y.

[21] Appl. No.: 08/780,671

[22] Filed: Jan. 10, 1997

[51] Int. Cl.[7] ..... B67D 5/52

[52] U.S. Cl. ..... 222/137; 222/135; 222/136; 222/145.5; 222/321.7

[58] Field of Search ..... 222/135, 136, 222/137, 321.7, 145.5, 145.6

[56] References Cited

U.S. PATENT DOCUMENTS

| | | |
|---|---|---|
| D. 18,219 | 4/1888 | Atterbury . |
| D. 95,787 | 6/1935 | Ahrens . |
| D. 309,860 | 8/1990 | Fossati . |
| D. 322,752 | 12/1991 | Zintzmeyer . |
| D. 340,644 | 10/1993 | Hirst . |
| D. 353,099 | 12/1994 | Poisson . |
| D. 356,494 | 3/1995 | Eke et al. . |
| D. 362,626 | 9/1995 | Rossi . |
| 3,291,346 | 12/1966 | Marraffino . |
| 3,459,332 | 8/1969 | Golden . |
| 3,704,812 | 12/1972 | Marand . |
| 3,760,986 | 9/1973 | Castner et al. . |
| 4,773,562 | 9/1988 | Gueret . |
| 4,791,149 | 12/1988 | Pocknell . |
| 4,826,048 | 5/1989 | Skorka et al. . |
| 4,871,092 | 10/1989 | Maerte . |
| 4,902,281 | 2/1990 | Avoy . |
| 4,925,066 | 5/1990 | Rosenbaum . |
| 4,964,539 | 10/1990 | Mueller . |
| 5,137,178 | 8/1992 | Stokes et al. . |
| 5,152,431 | 10/1992 | Gardner et al. . |
| 5,152,461 | 10/1992 | Proctor . |
| 5,332,157 | 7/1994 | Proctor . |
| 5,385,270 | 1/1995 | Cataneo et al. . |
| 5,398,846 | 3/1995 | Corba et al. . |
| 5,402,916 | 4/1995 | Nottingham et al. . |
| 5,472,119 | 12/1995 | Park et al. . |

FOREIGN PATENT DOCUMENTS

| | | |
|---|---|---|
| 2029332 | of 0000 | Canada . |
| 443 518 | of 0000 | European Pat. Off. . |
| 751 077 | of 0000 | European Pat. Off. . |
| 297 17 267 U | of 0000 | Germany . |
| 97/27841 | of 0000 | WIPO . |

*Primary Examiner*—David J. Walczak
*Assistant Examiner*—Timothy L. Maust
*Attorney, Agent, or Firm*—Gerard J. McGowan, Jr.

[57] ABSTRACT

A dual interlocked chamber dispenser having pumps for each chamber. An adapter which connects the chambers to the pump shell is snap fit to the chambers. The chambers may be of various desirable ergonomic shapes.

16 Claims, 6 Drawing Sheets

DUAL COMPARTMENT PACKAGE AND PUMPS

BACKGROUND OF THE INVENTION

There is sometimes a need in the packaging of consumer products to keep separated two of the components until such time as the product is actually to be used. An example is the Mentadent® brand of toothpaste. In that product, a peroxide-containing formulation and a bicarbonate-containing formulation are kept separate prior to dispensing to prevent premature interaction of the components.

Another example where it may be desirable to keep components separate in a consumer product would be a cleaning composition where it is necessary to keep a bleaching agent separate from another component such as an enzyme, to avoid undesirable interaction. Other examples include popular skin products having both surfactants for cleansing and a separate moisturizing ingredient.

Particularly if the products are relatively viscous it is desirable to provide pumps to assist the consumer in dispensing. Also, it is sometimes desirable that both products be dispensed in equal quantities at similar flow rates.

Various pumps and dispensers are disclosed in the literature.

Stokes et al., U.S. Pat. No. 5,137,178 discloses a dispenser wherein product components such as facial lotion and makeup can be kept in separate chambers prior to dispensing.

Maerte, U.S. Pat. No. 4,871,092 discloses an atomizing or metering pump wherein it is possible to adjust the metering or atomizing quantity. The metering or atomizing quantity can be adjusted, eg. by twisting the operating pusher with respect to the pump casing.

Marraffino, U.S. Pat. No. 3,291,346 discloses a blending device for blending hot water with creme to convert the creme into a wet or moist hot, foamy lather which issues from a shaving creme dispenser. A tube 15 extends into the shaving cream within the container.

Golden, U.S. Pat. No. 3,459,332 is directed to a pneumatic control system for dispensing metered quantities of liquid from one or more different liquid supply chambers in an automatic manner so that the dispensed liquid will be in proper quantities for providing a predetermined mixture of liquids, each dispensing operation being effected by pneumatically controlled actuator means. A tubular extension 18 extends into the supply chamber. A compression spring 41 is used.

Gueret, U.S. Pat. No. 4,773,562 discloses a dispenser head fitted on two separate reservoirs for mixing separate pasty substances wherein two ducts open into a mixing chamber which in turn opens out to the outside of the container. The reservoirs are said to be chosen from the group formed by pressurized containers of the aerosol can type, the containers comprising a manual ejection pump, and piston dispensers equipped in their upper portion with a non-return valve and in their lower portion with a follower piston.

Pocknell, U.S. Pat. No. 4,791,149 discloses a package having two separate compartments where the ingredients present in each such compartment do not react with each other, there being a propellant located between a membrane and the container whereby the membrane may be caused by the propellant gas to expel the component when required.

Skorka, U.S. Pat. No. 4,826,048 discloses a dispenser having two reservoirs for separate media components. Each reservoir has a separate discharge pump, both discharge pumps being simultaneously operable by means of a common handle. The pumps are preferably thrust piston pumps. Suction channels 17 formed by riser tubes extend into each reservoir to the vicinity of the bottom. Two bottle necks 4 are interconnected by means of a top cap 5.

Marand, U.S. Pat. No. 3,704,812 is directed to a dispenser including several fluid components in isolated sack chambers.

Cataneo et al., U.S. Pat. No. 5,385,270 is directed to an apparatus for dispensing two flowable substances in a user selectable ratio. The selector member is selectively rotatable with respect to the container between a series of predetermined positions where the selector member opening is either in full registry, partial registry or not in registry with the open ends of each of the chambers, such as upon compression of the outer container wall. A predetermined measure of flowable substance is dispensed from the dispensing end of the container with a ratio of the flowable substances from the two chambers being selectively variable.

Friction gripping dots have been used in shower gel containers in Japan.

Cordery et al. EP 468 703 discloses a shampoo system comprising a first pack including a surfactant and a cationic conditioning polymer and a second pack containing a benefit agent. The first and second packs are adapted to be mixed together before use. The benefit agent is said preferably to be chosen from among sunscreens, certain silicones, perfumes, hair growth agents, hair moisturizers, anti-dandruff agents, bodying agents, shine enhancers and setting agents.

The German company, Wiko, has developed a dual pump wherein two cylindrical chambers comprise fluid. During pumping, piston beneath the fluid contents travels upwardly. Fluid is pumped through a first valve into a displacement area and then through a second valve and out of the container. The products in the separate chambers only mix after they exit the container. The pumping action is initiated by pressing downwardly on a spring biased actuator.

Mueller, U.S. Pat. No. 4,964,539 discloses a multiple chamber dispensing container having a cap with sealing members 80 in the shape of a sector of a circle.

SUMMARY OF THE INVENTION

In a first aspect, the present invention is directed to a dual chamber dispenser. The dispenser includes at least two interlocking chambers, pumps for each chamber and preferably a single, unitary pump actuator. Advantageously, each pump has a dip tube which conveys the product in the chamber to the pump and then to a respective channel conveying the product outside of the dispenser.

In another aspect, the invention is directed to a dual dispenser having an adapter into which dual chambers are snap fit. By providing a snap fit instead of threads which must be closed by rotation of the parts, greater freedom in designing the shape of the chambers is afforded.

The dispenser of the invention is designed preferably to deliver equal amounts of two liquid products. Preferably the two chambers are connected together either mechanically or with an adhesive. For example, the chambers may be provided with mating male and female members. The dispenser is designed to be hand held and is particularly useful in shower products where shelf space is limited. Advantageously, the dispenser may include friction dots or other gripping means on each of the chambers to assist in gripping the dispenser during use in the shower.

In accordance with another advantageous aspect of the invention, the pumps' fluid accumulation chambers are disposed outside (above) the chambers, in contrast to certain prior art arrangements. Among other things, this maximizes the space within the chamber which may be taken up with product.

The invention is also directed to a discrete adapter having a septum, at least two openings in the septum, a lower flange for making a snap fit association with the chambers and channels surrounding each of the septum openings for receiving finishes in the chambers. The adapter also advantageously includes an upper flange to assist in association with a pump shell, and conical depressions extending into the upper surface of the septum surrounding the septum openings.

The invention permits use of non-cylindrical chambers by removing the need to screw the chambers to an adapter and by eliminating the need for a following piston in the chambers. This permits the chambers to have profiles which are better suited to maximizing volume while being readily grasped in one hand.

For a more complete understanding of the above and other features and advantages of the invention, reference should be made to the following detailed description of the preferred embodiments and to the accompanying drawings.

DETAILED DESCRIPTION OF THE INVENTION

Figure 8:
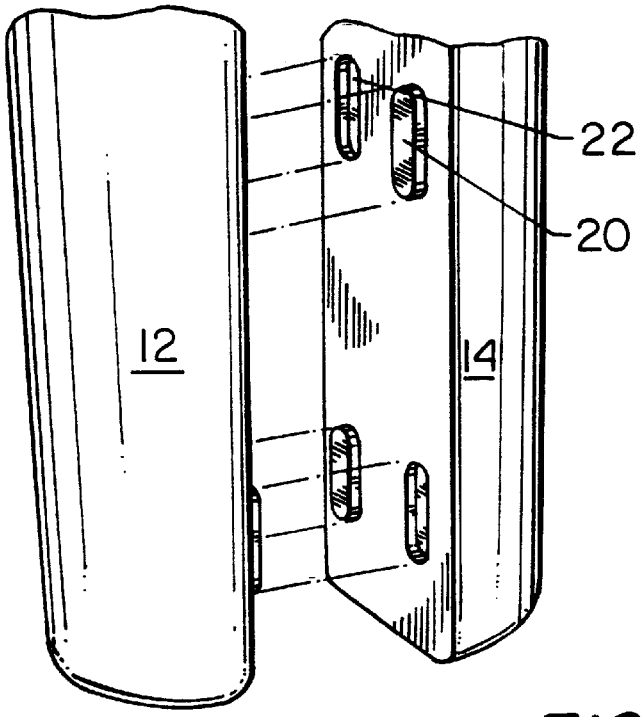
FIG. 8 is a partial perspective view of the dispenser of the invention showing the chambers separated.
Figure 9:
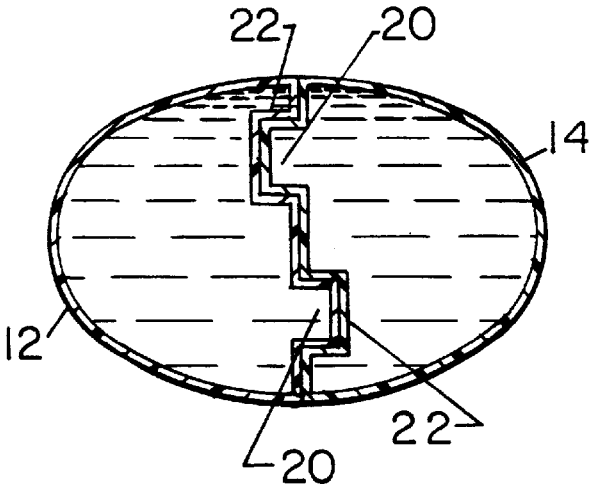
FIG. 9 is a cross section along the lines 9—9 of FIG. 1.

Container 10 comprises two chambers 12 and 14. Chambers 12 and 14 preferably form two halves of a cross sectional geometric figure such as the oval seen in FIG. 9. Preferably the two chambers are interlocked as by projections 20 received within openings 22 as seen particularly in FIGS. 8 and 9.

Each of chambers 12 and 14 may be provided with raised dots 24 (FIG. 2) or other gripping means to facilitate grasping of the container in the shower. As seen particularly in FIGS. 10 and 11, chambers 12 and 14 include finishes 30 which surround product openings 32.

Figure 1:
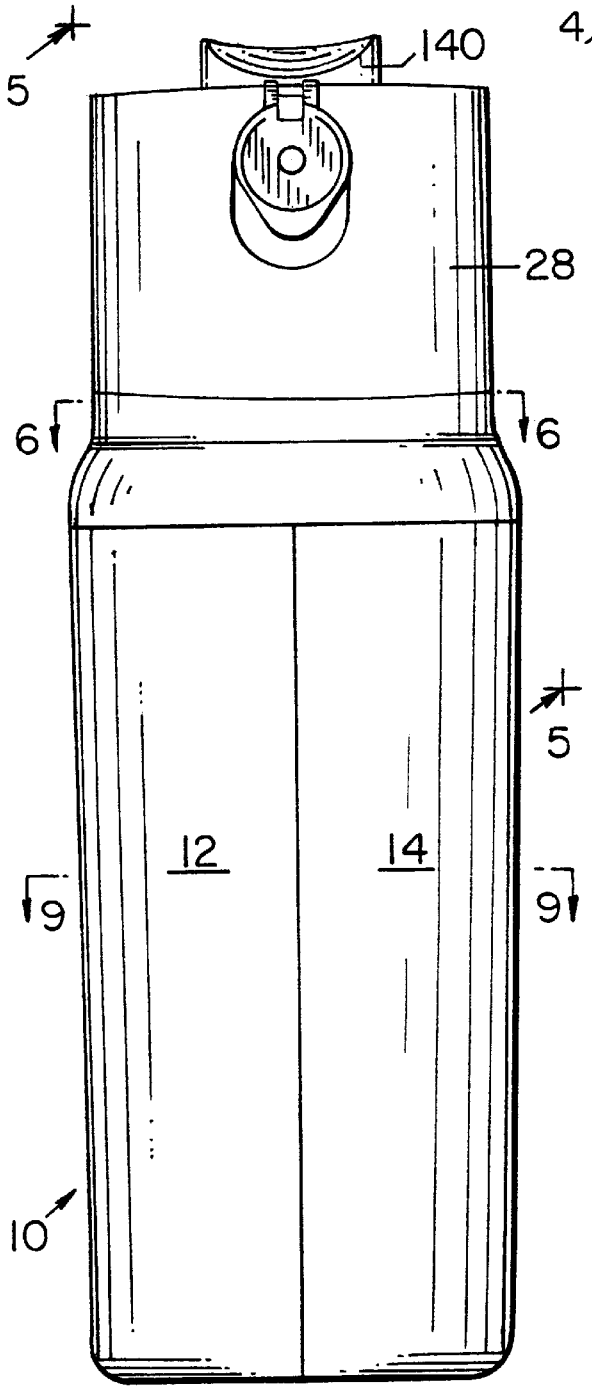
FIG. 1 is a front elevational view of a dual dispenser according to the invention.
Figure 2:
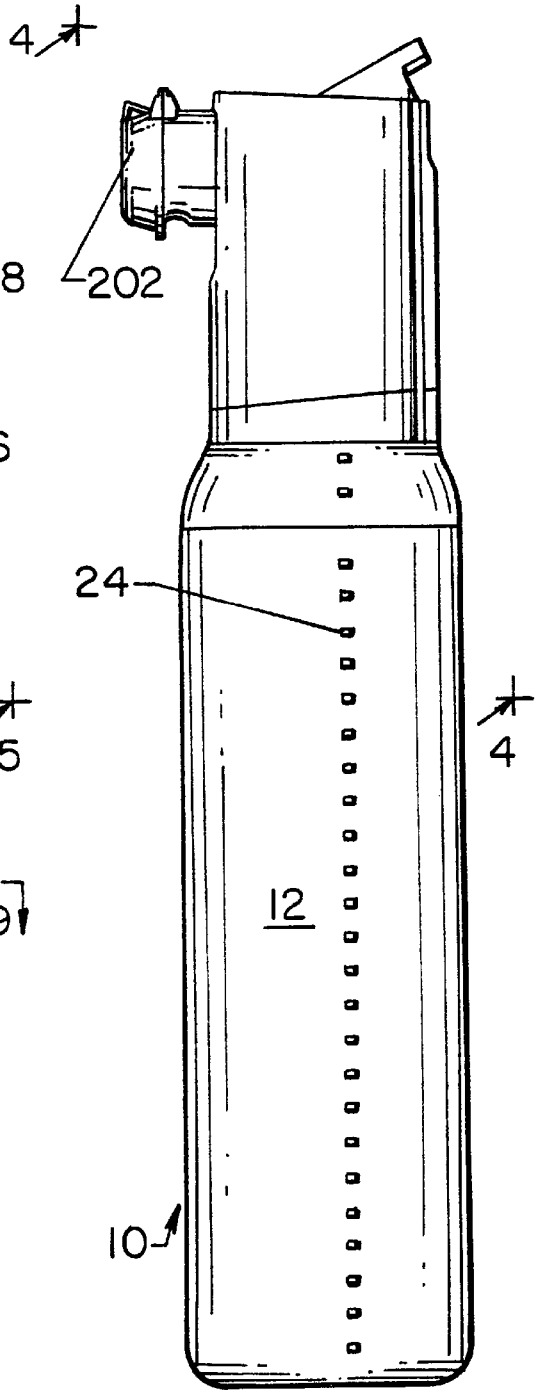
FIG. 2 is a side elevational view of the dispenser of the invention.
Figure 3:
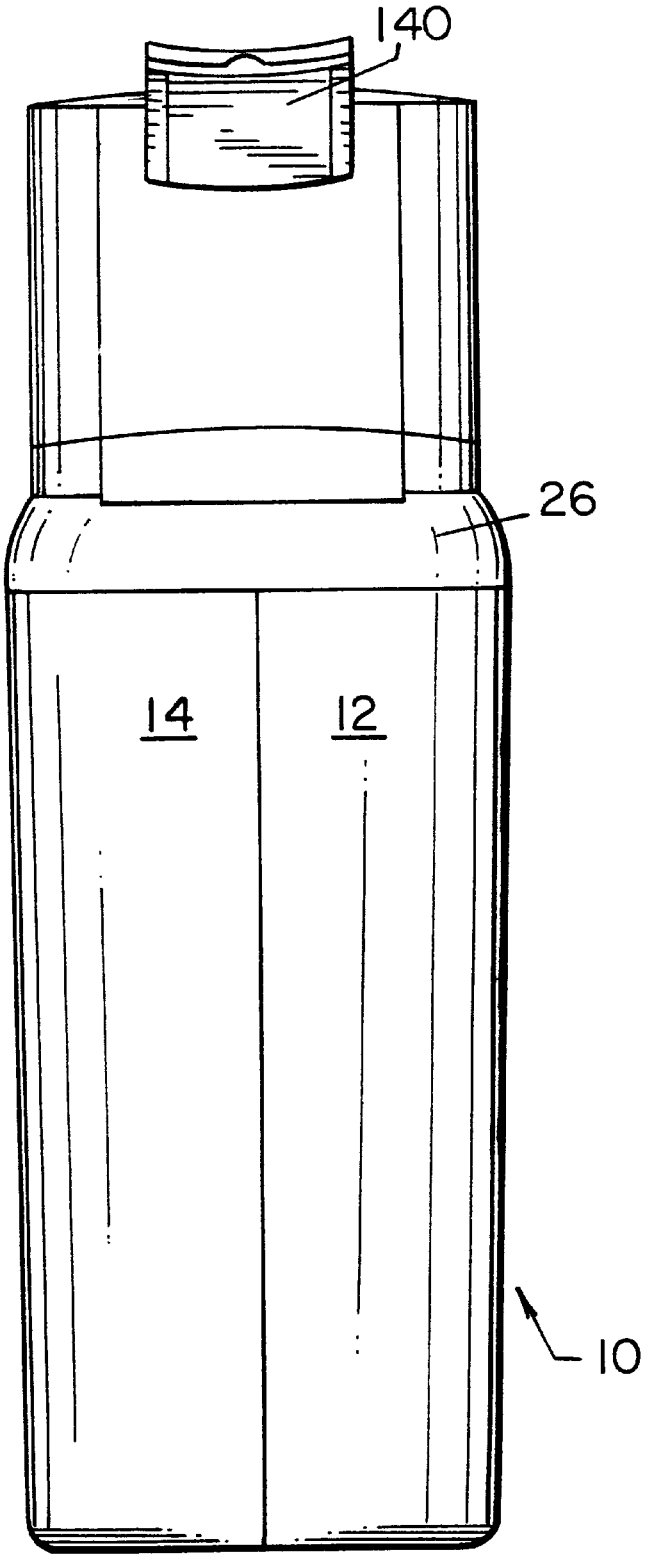
FIG. 3 is a rear elevational view of the dispenser according to the invention.

As seen in FIGS. 1–3, above chambers 12 and 14 is adapter 26 and pump shell 28.

Figure 5:
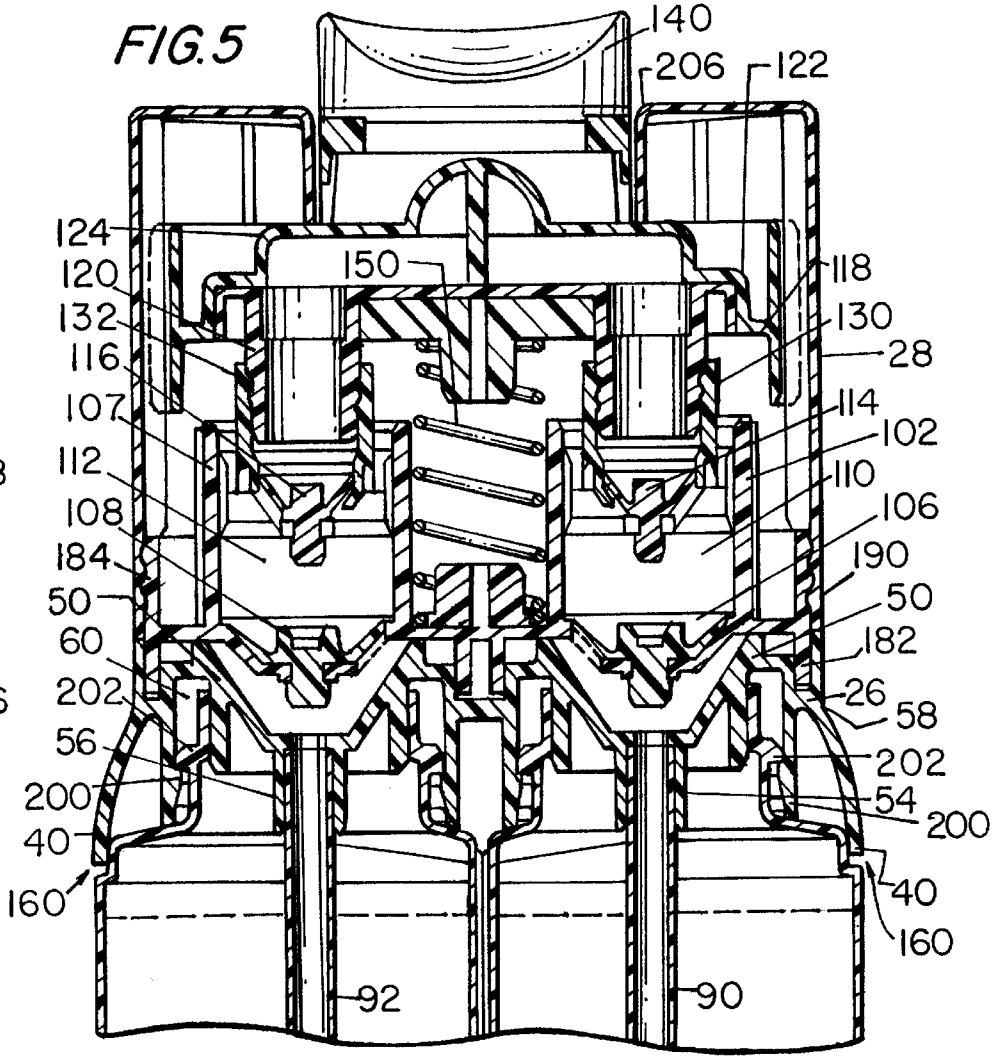
FIG. 5 is a partial cross section along the lines 5—5 of FIG. 1.
Figure 4:
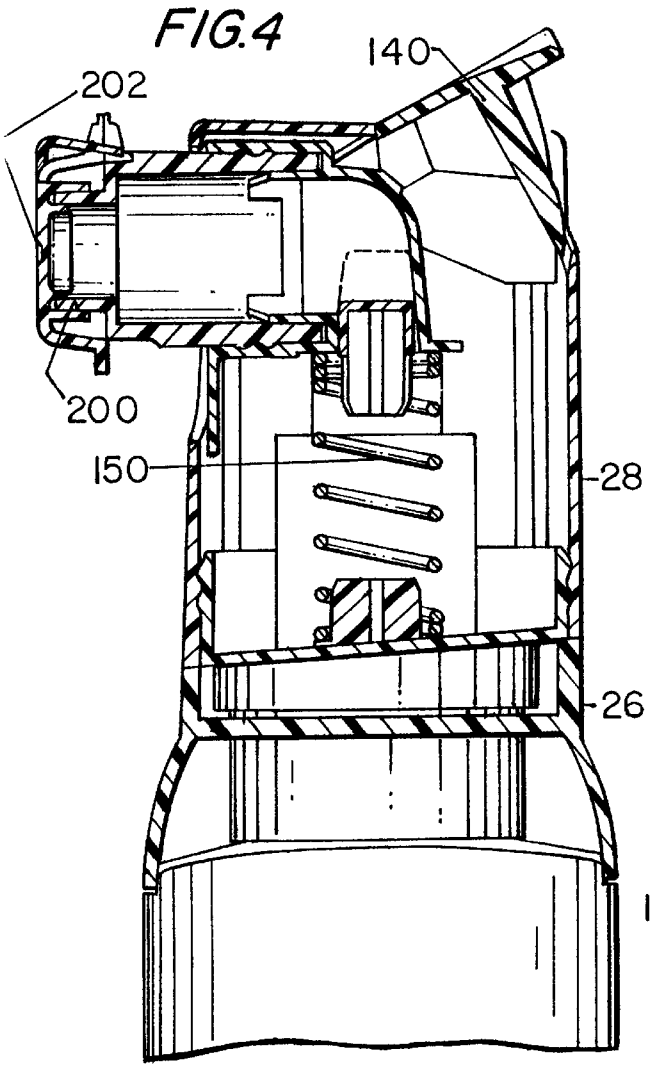
FIG. 4 is a partial cross section along the lines 4—4 of FIG. 2.
Figure 6:
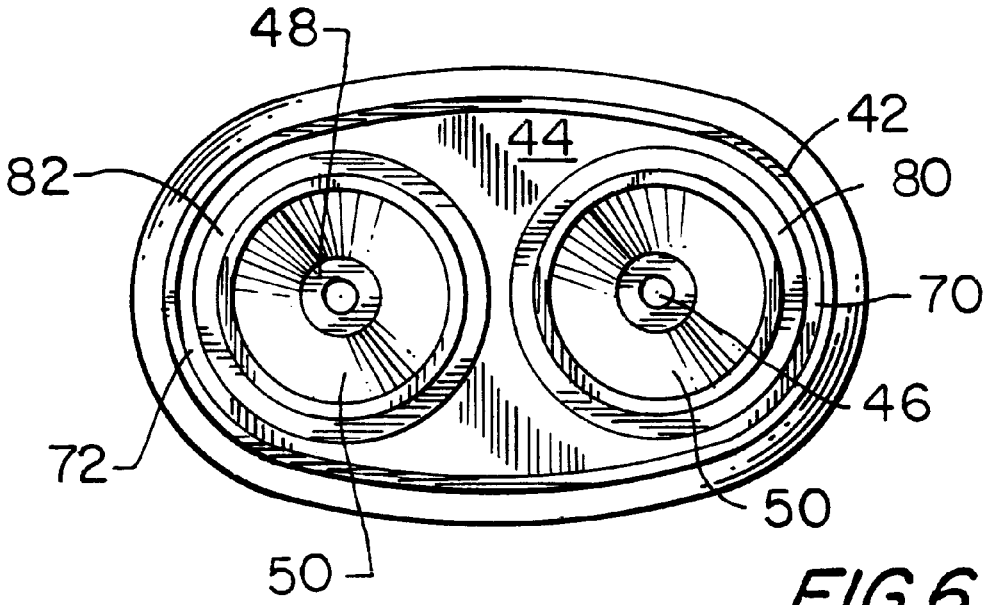
FIG. 6 is a cross section along the lines 6—6 of FIG. 1.
Figure 7:
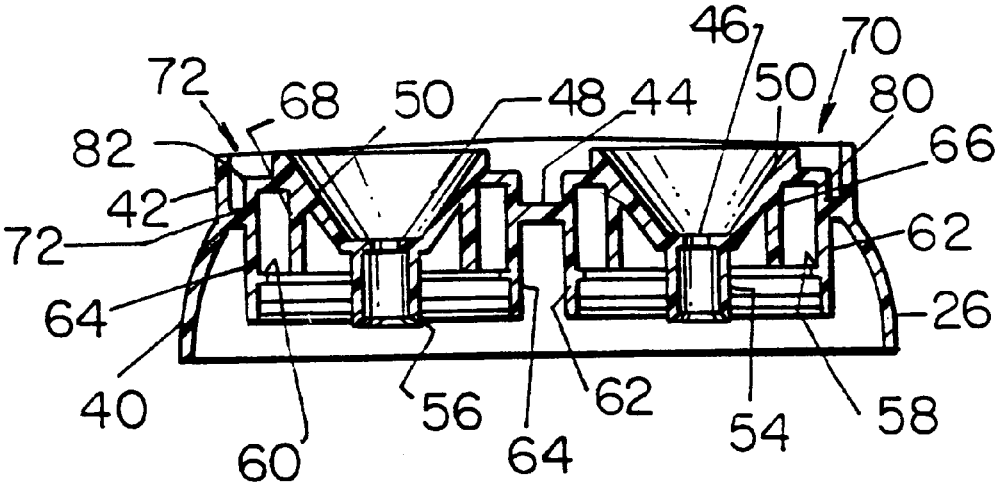
FIG. 7 is an isolated view of the adapter visible in FIG. 5.

Referring particularly to FIGS. 5 and 7, adapter 26 includes lower flange 40 and upper flange 42. Septum 44 separates the spaces above and below the adapter. The adapter is provided with product openings 46 and 48 which are surrounded on the upper side of adapter 26 by cone shaped structures 50. Below product openings 46, 48 are tube stubs 54, 56. Surrounding tube stubs 54, 56 are channels 58, 60 which are formed respectively by outer cylinders 62, 64 and inner cylinders 66, 68. Channels 70, 72 are formed on the upper side of the adapter 26 between upper flange 42 and circular walls 80, 82 surrounding cone shaped structures 50.

Chambers 12, 14 include shoulder 160 along their non-mating peripheries. Lower flange 40 of adapter 26 is snap fit atop shoulder 160. Flanges 182, 184 of pumps 102, 104 are received within channels 70, 72 of adapter 26. Cylindrical wall 190 of pump shell 28 rests upon the top edge of upper flange 42 of adapter 26. Pump shell 28 may be adhered to the pumps and/or to adapter 26 with chemical adhesive.

As best seen in FIG. 5, dip tubes 90, 92 are inserted within or otherwise connected to adapter tube stubs 54, 56. Finishes 30 of chambers 12 and 14 are inserted within channels 58, 60 and held there by the action of locking ridges 200 against flanges 202 on finishes 30.

Disposed above conical depressions 50, are conventional pump mechanisms 102, 104. Conventional pump mechanisms include first valves 106, 108. Above valves 106, 108 are fluid accumulation chambers 110, 112, above which are second valves 114, 116.

Disposed above valves 114, 116 are vertical product channels 118, 120. The vertical product channels are in communication with horizontal product channels 122, 124. Channels 118, 120 are received within sleeves 130, 132. Unitary pump actuator 140 extends through opening 206 in pump shell 28 and serves as a pump actuator for both pumps 102 and 104. Actuator 140 is disposed so as to push the horizontal channels 122, 124 and vertical channels 118, 120 downwardly when a finger exerts pressure on the actuator. The downward movement of the channels is resisted by spring 150.

In operation, the chambers 12, 14 may be filled either before or after they are interlocked. The chambers may be adhered together with chemical adhesive, if desired. Into the chambers are inserted dip tubes 90, 92 of pumps 102, 104 and adapter 26 is snap fit atop chambers 12, 14 and into chamber finishes 30. Preassembled together with adapter 26 are preferably pumps 102, 104 and pump shell 28.

When it is desired to pump product from the chambers, closure 202 is snapped open and the user's finger depresses actuator 140, which in turn depresses channels 122, 124 and 118, 120. Sleeves 130, 132 are stationery with respect to the actuator, so channels 118, 120 slide within the sleeves. Release of actuator 140 causes channels 122, 124 and 118, 120 to return to their original positions, by virtue of the force exerted by spring 150. This creates a suction which draws fluid upwardly through tubes 90, 92 and through valves 106, 108. At the same time fluid which will have accumulated in chambers 110, 112 (assuming the actuator had previously been depressed) is drawn by suction through valves 114, 116 and into channels 118, 120, 122, 124 and out of the container. Horizontal channels 122, 124 may lead to separate openings or to a single combined opening, if so desired.

The snap fit adapter and the use of the dip tube permit the dispenser to include chambers of various shapes. This may be desirable, for instance, to make the dispenser easier to hold. Certain prior art dispensers, for instance, have utilized pistons at the bottom of the product-containing chambers which are drawn upwardly during dispensing. Use of such pistons have limited the shape of the chambers to essentially cylindrical profiles. Use of the dip tube in the present invention has eliminated the need for the cylindrical profiles. Use of the snap fit adapter also enhances the flexibility in selection of chamber profile since some prior art chambers have required round shapes due to the fact that other adapters have been mated to the chambers using screw threads. Again, the snap fit adapter increases the flexibility in selection of chamber shape.

The adapter of the invention additionally permits easy mating of the bottle finishes to the rest of the dispenser via channels 58, 60. Also, channels 70, 72 facilitate linking of pumps 102, 104 with the adapter.

The freedom to deviate from cylindrical chamber profiles permits use of the dispenser having an ergonomic overall profile, such as the oval profile shown, yet maximizing the amount of product which can be contained in the chambers. The interlocking of the chambers and the snap fit of the chambers to the adapter permit convenient refilling of one or both of the chambers as the product contents are consumed.

Figure 10:
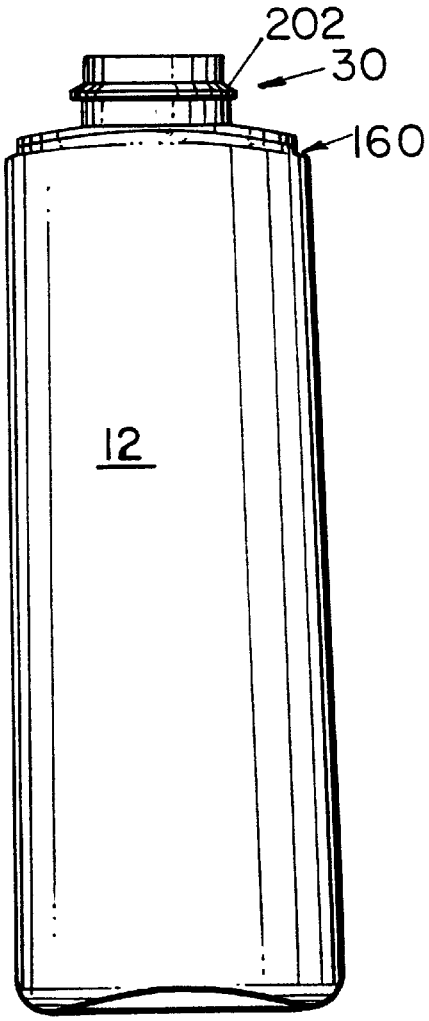
FIG. 10 is a side elevational view of one of the chambers used in the dispenser of the invention.
Figure 11:
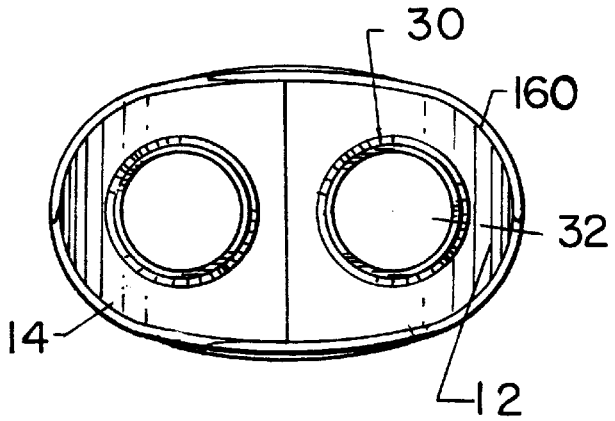
FIG. 11 is a top plan view of two of the chambers of FIG. 10 interlocked together in accordance with the invention.

Use of the dip tubes not only eliminates the need for cylindrical chambers, it also eliminates the requirement that the chambers be straight sided. Thus, if desired, the chambers may be tapered, as seen in FIG. 10.

While the adapter may be a separate piece as illustrated, if desired, it may be integral to the chambers and/or the pump and pump shell.

The oval shape of the dispenser assists the user in grasping it in one hand. The chambers and the pumps are preferably identical. This helps conserve manufacturing resource.

The dispenser is preferably made of one or more polyolefins, such as polypropylene. The compartments of the dispenser may be extrusion blow molded.

It should be understood of course that the specific forms of the invention herein illustrated and described are intended to be representative only, as certain changes may be made therein without departing from the clear teaching of the disclosure. Accordingly reference should be made to the appended claims in determining the full scope.

What is claimed is:

1. A dispenser comprising a first compartment having a product chamber, a first pump operatively associated with said chamber, said first pump having a fluid inlet within said first chamber, and a first fluid outlet, a second pump operatively associated with a second compartment having a product chamber, said second pump having a fluid inlet within said second chamber, and a second fluid outlet, an adapter comprising a septum, a plurality of openings in said septum, an upper peripheral flange on the periphery of at least a portion of said septum and a lower peripheral flange on the periphery of at least a portion of said septum, said lower flange being snap fit onto said chambers.

2. The dispenser according to claim 1 further comprising a plurality of grip facilitating protuberances on each of said chambers.

3. The dispenser according to claim 1 further comprising a dip tube attached to an underside of said plurality of septum openings and in fluid communication with said openings.

4. The dispenser according to claim 1 wherein said first and second chambers have finishes surrounding a product exit opening said adapter including channels at least partly surrounding at least two of said septum openings, said channel receiving said chamber finishes.

5. The dispenser according to claim 1 wherein said upper flange is associated with a pump shell covering said pumps.

6. The dispenser according to claim 1 wherein said pump shell includes openings for a pump actuator and for a product egress channel.

7. The dispenser according to claim 1 wherein said pumps each comprise a fluid accumulating chamber and said septum is disposed between each of said product chambers and each said fluid accumulating chamber.

8. The dispenser according to claim 1 wherein said first pump fluid inlet comprises a first dip tube, and said second pump fluid inlet comprises a second dip tube, said first and second chambers being interlocking, said dispenser further comprising a spring biased actuator for said first and second pumps.

9. The dispenser according to claim 8 wherein at least one of said chambers includes a male member and at least one of said chambers includes a female member said chambers interlocking by mating of said male and female members.

10. The dispenser according to claim 8 wherein at least one of said chambers includes a male member and at least one of said chambers includes a female member said chambers interlocking by mating of said male and female members.

11. The dispenser according to claim 8 wherein said spring biased actuator is a common one used to actuate both pumps.

12. The dispenser according to claim 8 further comprising a plurality of grip facilitating protuberances on each of said chambers.

13. The dispenser according to claim 12 wherein said protuberances are circular.

14. The dispenser according to claim 12 wherein said protuberances are circular.

15. An adapter having a septum, at least two openings in the septum, a lower flange extending from at least a portion of the periphery of said septum adapted for making a snap fit association with a container and channels surrounding each of the septum openings for receiving container finishes, said adapter further comprising conical depressions extending into the upper surface of the septum surrounding the septum openings.

16. The adapter according to claim 15 further comprising an upper flange extending from at least a portion of the periphery of said septum.

* * * * *